US006889635B2

(12) United States Patent
Geisheker et al.

(10) Patent No.: US 6,889,635 B2
(45) Date of Patent: May 10, 2005

(54) BLOWER HOUSING FOR INTERNAL COMBUSTION ENGINE

(75) Inventors: Richard C. Geisheker, Oconomowoc, WI (US); Gary Furlano, West Bend, WI (US)

(73) Assignee: Briggs & Stratton Corporation, Wauwatosa, WI (US)

( * ) Notice: Subject to any disclaimer, the term of this patent is extended or adjusted under 35 U.S.C. 154(b) by 38 days.

(21) Appl. No.: 10/364,157

(22) Filed: Feb. 11, 2003

(65) Prior Publication Data

US 2004/0154559 A1 Aug. 12, 2004

(51) Int. Cl.[7] ..... F01P 7/04
(52) U.S. Cl. ..... 123/41.65; 123/41.7; 123/198 E
(58) Field of Search ..... 123/41.56, 41.6, 123/41.61, 41.63, 41.64, 41.65, 41.66, 41.67, 41.7, 198 E

(56) References Cited

U.S. PATENT DOCUMENTS

| | | | | |
|---|---|---|---|---|
| 2,217,002 A | * | 10/1940 | Burbank | 123/41.65 |
| 2,747,558 A | * | 5/1956 | Kiekhaefer | 123/41.65 |
| 3,952,712 A | | 4/1976 | Hermanson | |
| 4,204,486 A | | 5/1980 | Nakagawa et al. | |
| 4,798,182 A | | 1/1989 | Ebinuma et al. | |
| 4,890,584 A | | 1/1990 | Tamba et al. | |
| 5,285,751 A | | 2/1994 | Liegeois et al. | |
| 5,813,384 A | * | 9/1998 | Lavender et al. | 123/198 E |
| 6,145,479 A | | 11/2000 | Rotter | |
| 6,355,077 B1 | | 3/2002 | Chittenden et al. | |

FOREIGN PATENT DOCUMENTS

| | | |
|---|---|---|
| FR | 872.991 | 6/1942 |
| GB | 535513 | 4/1941 |

* cited by examiner

*Primary Examiner*—Noah P. Kamen
(74) *Attorney, Agent, or Firm*—Michael Best & Friedrich, LLP

(57) ABSTRACT

A blower housing is coupleable to an engine including a cooling fan that is rotatable about an axis. The blower housing includes a first housing portion that is coupled to the engine and has an intake opening through which air may flow. The blower housing also includes a removable housing portion that is removably coupled to the first housing portion and has first and second sidewalls that direct air toward at least one engine cylinder. In one embodiment, the first and second sidewalls direct air toward different engine cylinders, in another embodiment, the first and second sidewalls direct air toward the same engine cylinder.

34 Claims, 4 Drawing Sheets

BLOWER HOUSING FOR INTERNAL COMBUSTION ENGINE

FIELD OF THE INVENTION

The invention relates to internal combustion engines, and more particularly to a blower housing for an internal combustion engine.

BACKGROUND OF THE INVENTION

Many internal combustion engines are provided with fans or blowers that force cooling air over certain engine surfaces during engine operation. Some engines include engine cylinders and cylinder heads that incorporate heat sinks in the form of cooling fins. While the particular arrangement and orientation of the cooling fins varies, substantially all the cooling fins dissipate heat more effectively as increased amounts of air are circulated over the cooling fin surfaces. In this regard, fans and blowers are often provided to force air over the cooling fins, thereby cooling the engine. To further enhance the circulation of cooling air, and to thereby improve the engine cooling process, many engines include special housings and/or ductwork that guide the cooling air to different areas of the engine that require cooling. For engines operating in environments having significant amounts of air-borne dust and particulate debris, screens, filters, and the like are often provided in an attempt to reduce the amount of dust and debris that enters the housings and ductwork.

SUMMARY OF THE INVENTION

The present invention provides a blower housing that is coupleable to an engine. The engine includes a cooling fan that is rotatable about an axis and the blower housing includes a first housing portion that is coupled to the engine and has an intake opening through which air may flow. The blower housing also includes a removable housing portion that is removably coupled to the first housing portion and has first and second sidewalls that direct air toward at least one engine cylinder.

In some embodiments, the engine includes first and second engine cylinders, the first sidewall directs air toward the first engine cylinder, and the second sidewall directs air toward the second engine cylinder. A third wall may be provided that extends between the first and second sidewalls generally normal to the axis and at least partially overlies a carburetor of the engine. The removable housing portion can be slideably engageable with the first housing portion by a slot and rib arrangement. In some embodiments, the first housing portion defines a first access opening that opens toward the first engine cylinder, and a second access opening that opens toward the second engine cylinder. The first sidewall can be configured to overlie the first access opening and the second sidewall can be configured to overlie the second access opening when the removable housing portion is coupled to the first housing portion.

In other embodiments, the first and second sidewalls direct air toward the first engine cylinder and the removable housing portion further includes third and fourth sidewalls that direct air toward the second engine cylinder. The first housing portion defines an access opening that opens toward the first and second cylinders, and the removable housing portion overlies the access opening and directs air toward the engine cylinders when the removable housing portion is coupled to the first housing portion.

Other features of the invention will become apparent to those skilled in the art upon review of the following detailed description, and drawings.

Figure 1:
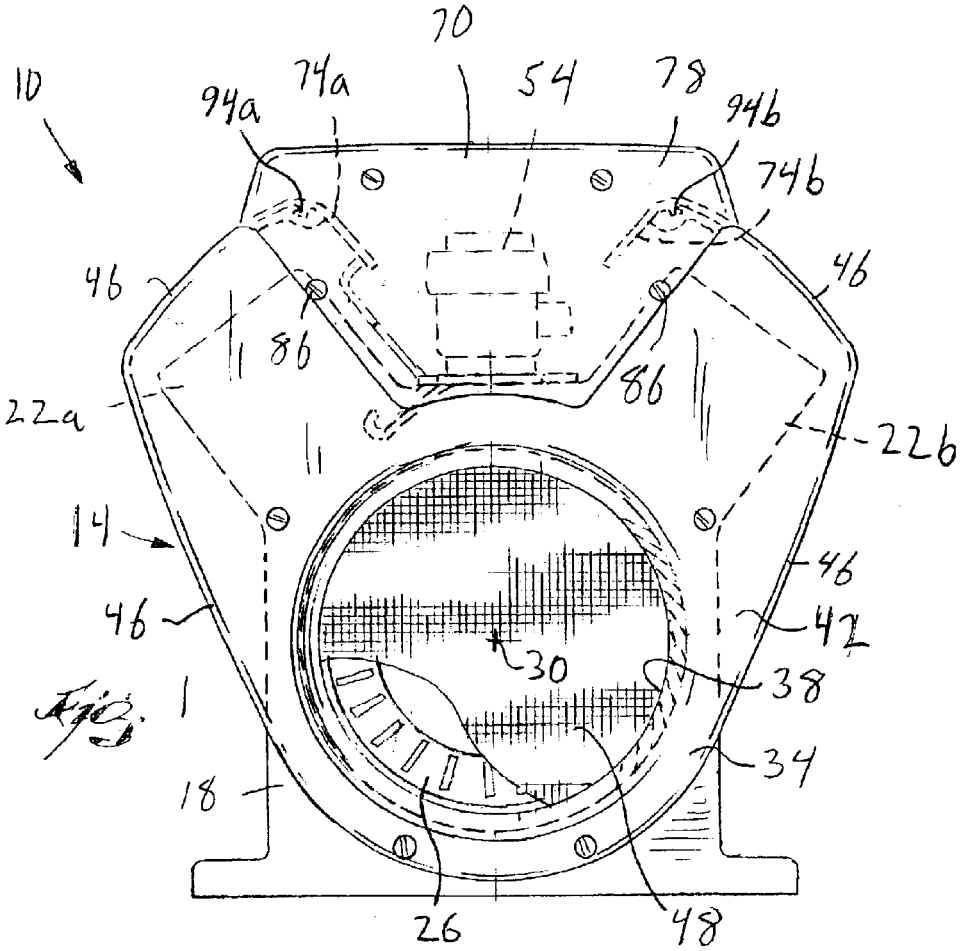
FIG. 1 is an end view of an internal combustion engine including a blower housing embodying the invention.
Figure 4:
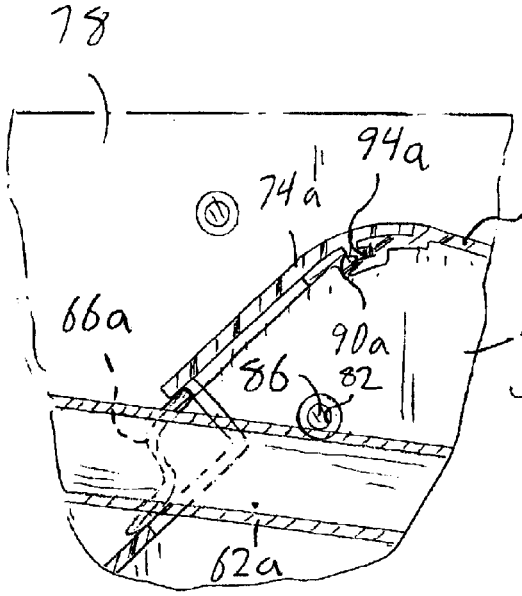
FIG. 4 is a section view of the encircled area of FIG. 2.
Figure 2:
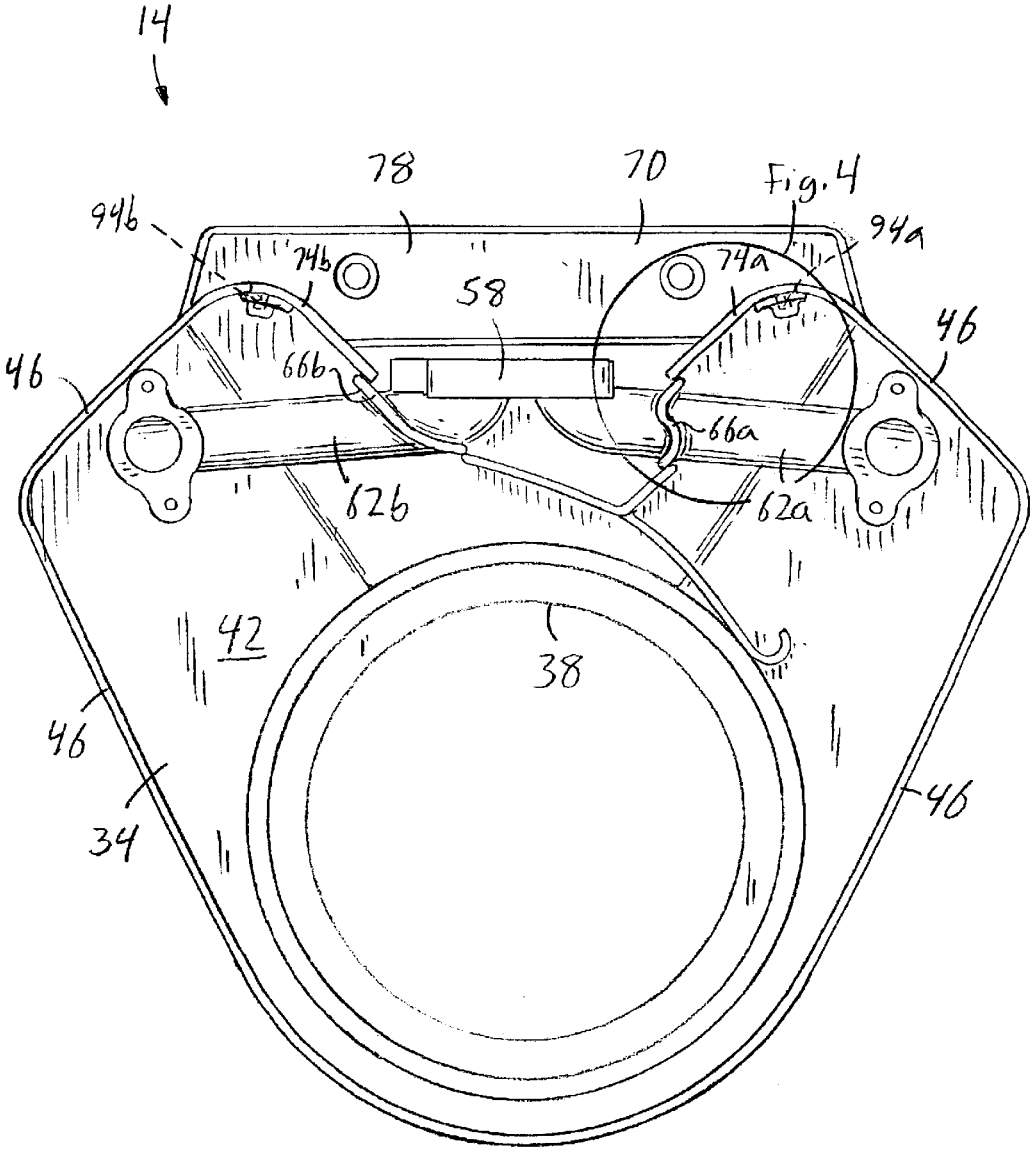
FIG. 2 is an end view of the inside portion of the blower housing illustrated in FIG. 1.

Before one embodiment of the invention is explained in detail, it is to be understood that the invention is not limited in its application to the details of construction and the arrangements of the components set forth in the following description or illustrated in the drawings. The invention is capable of other embodiments and of being practiced or being carried out in various ways. Also, it is understood that the phraseology and terminology used herein is for the purpose of description and should not be regarded as limiting. The use of "including" and "comprising" and variations thereof herein is meant to encompass the items listed thereafter and equivalents thereof as well as additional items.

DETAILED DESCRIPTION

The figures illustrate an internal combustion engine 10 and blower housing 14 embodying the present invention. The illustrated engine 10 includes an engine block 18 that rotatably supports a crankshaft (not shown) and first and second engine cylinder assemblies 22*a*, 22*b* that each include an engine cylinder and engine cylinder head, as is known in the art. The cylinder head may be integrally formed with the cylinder, or the cylinder head and cylinder may be separate components. The cylinder assemblies 22*a*, 22*b* extend from the engine block 18 at an angle with respect to one another. In this regard the illustrated engine 10 is a V-twin engine, however the blower housing 14 can be adapted for use with other types of engines having other cylinder configurations including, without limitation, single-cylinder engines and multi-cylinder engines of inline, opposed, radial and V configurations, for example. In addition, the blower housing 14 can be utilized with engines having horizontal or vertical crankshafts, or with engines that can be operated in a variety of operating orientations.

The engine 10 also includes a cooling fan 26 that is supported for rotation about an axis 30. In some embodiments, the cooling fan 26 is coupled to an end of the crankshaft that extends from the engine block 18, however other fan configurations are possible as well. The cooling fan 26 is rotatable about the axis 30 to enhance the flow of air over various engine surfaces to cool the engine 10, as is known in the art.

The blower housing 14 is coupled to the engine 10 and includes a first housing portion 34 that substantially overlies a portion of the engine block 18 and defines an intake opening 38. The intake opening 38 is in fluid communication with the cooling fan 26 and, in the illustrated embodiment, the intake opening 38 generally surrounds the cooling fan 26 and is substantially concentric with the axis 30.

The first housing portion 34 includes a front wall 42 that is substantially normal to the axis 30, spaced from the engine block 18, and defines the intake opening 38. The first housing portion 34 also includes sidewalls 46 that extend away from the front wall 42 toward the engine block 18. In some embodiments, the sidewalls 46 are coupled directly to the engine block 18. In other embodiments, additional walls, bosses, extensions and the like can be provided to couple the first housing portion 34 to the engine. The sidewalls 46 include both arcuate and planar sections, and extend generally parallel to the axis 30. Of course the specific configuration of the sidewalls 46 depends at least in part upon the configuration of the engine 10 to which the blower housing 14 is coupled. The front wall 42 and the sidewalls 46 cooperate with the engine block 18 to at least partially define an air flow chamber through which cooling air can flow. When the cooling fan 26 rotates, air is drawn through the intake opening 38 and into the first housing portion 34, the front wall 42 and the sidewalls 46 then guide the cooling air toward the cylinder assemblies 22*a*, 22*b*. Depending upon the engine configuration, the front wall 42 and sidewalls 46 can be configured to guide different amounts of cooling air to the engine cylinder and cylinder head. For example, if the engine is an overhead valve or overhead cam engine, the sidewalls 46 can be configured to guide a larger percentage of the cooling air toward the cylinder head, whereas if the engine is an L-head engine, the sidewalls 46 can be configured to guide a larger percentage of the cooling air toward the engine cylinder. Various types of internal baffles and/or additional passageways can be provided to distribute the cooling air according to the cooling requirements of a specific engine. A fan screen 48 is coupled to the cooling fan 26 or to the blower housing 14 to reduce the entry of air-borne dirt and debris into the blower housing 14.

Figure 3:
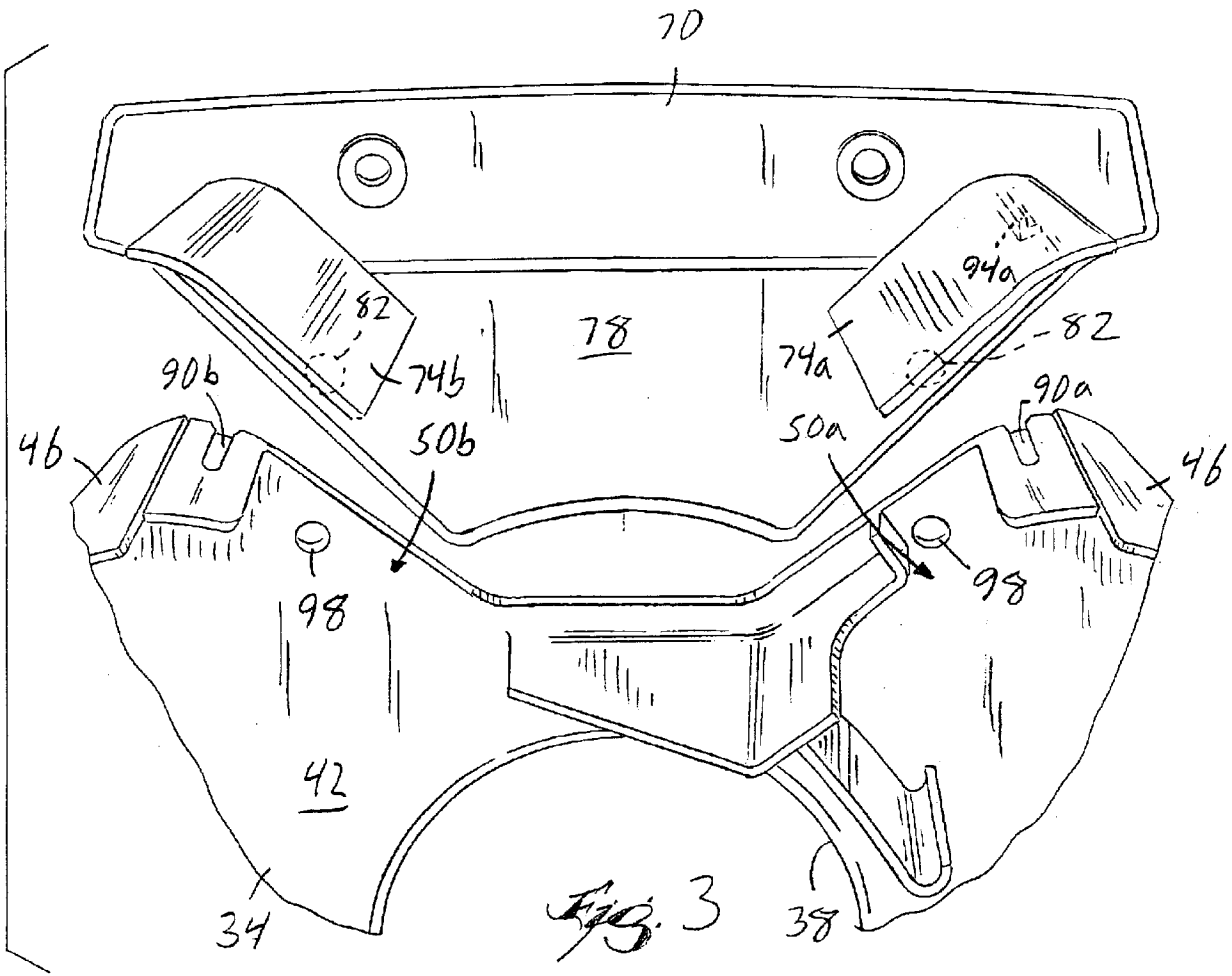
FIG. 3 is an enlarged perspective view of the blower housing illustrated in FIG. 1.

Despite the presence of the fan screen 48, a certain amount of dirt, debris, and other foreign material is inevitably introduced into the blower housing 14. To allow removal or cleaning of the foreign material from the blower housing 14, the first housing portion 34 defines access openings 50*a*, 50*b* that can be utilized to extract the foreign material from the blower housing 14. As best illustrated in FIG. 3, the front wall 42 and the sidewalls 46 cooperate to define the access openings 50*a*, 50*b*. The first access opening 50*a* opens toward the first cylinder assembly 22*a*, and the second access opening 50*b* opens toward the second cylinder assembly 22*b*, thereby affording access to the outer surfaces of at least one of the cylinders and cylinder heads of the engine cylinder assemblies 22*a*, 22*b* for cleaning thereof. In this regard, the air flow chamber can be cleaned without necessitating removal of the entire blower housing 14. This is particularly useful for applications in which the engine 10 is very close to adjacent components of the power equipment, or in applications in which power is taken from both ends of the crankshaft. In addition to providing easier cleaning of the air flow chambers, the blower housing 14 also improves the overall serviceability of the engine 10 to which it is coupled by affording access to other engine components that might be covered by the blower housing 14 such as, without limitation, spark plugs, ignition coils, various engine fasteners, and the like.

The engine 10 also includes an air/fuel mixing device that, in the illustrated embodiment, is a carburetor 54. The carburetor 54 is positioned between the engine cylinder assemblies 22*a*, 22*b* and supplies a mixture of fuel and air to the engine 10 by way of an intake manifold 58 as is known in the art. The intake manifold 58 includes runners 62*a*, 62*b* that deliver the fuel/air mixture to the cylinder heads of the first and second cylinder assemblies 22*a*, 22*b*, respectively. In the illustrated embodiment, each runner 62*a*, 62*b* is provided with a flange 66*a*, 66*b* that cooperates with the front wall 42 and the sidewalls 46 to further define the respective access openings 50*a*, 50*b*.

It should be appreciated that the engine 10 may be configured for use with other air/fuel mixing devices as well. For example a fuel injection system (not shown) including among other things a throttle body, a fuel rail, and one or more injectors can be provided to inject fuel into the throttle body, intake runners 62*a*, 62*b*, or directly into the engine combustion chamber. In other constructions, a gaseous fuel mixer (not shown) may be provided such that the engine can operate on fuels in gaseous form, such as natural gas, for example.

To close the access openings 50*a*, 50*b* during engine operation, the blower housing 14 also includes a removable housing portion 70 that, in the embodiment of FIGS. 1–4, is slideably coupled to the first housing portion 34. The removable housing portion 70 is provided with a substantially planar first sidewall 74*a* and a substantially planar second sidewall 74*b*. The sidewalls 74*a*, 74*b* are angled with respect to one another and are configured such that the first sidewall 74*a* overlies the first access opening 50*a* and the second sidewall 74*b* overlies the second access opening 50*b* when the removable housing portion 70 is coupled to the first housing portion 34. During engine operation, the first and second sidewalls 74*a*, 74*b* direct cooling air toward the first and second engine cylinder assemblies 22*a*, 22*b*, respectively. The first and second sidewalls 74*a*, 74*b* are configured to extend substantially parallel to the axis 30 when the removable housing portion 70 is in place.

The removable housing portion 70 also includes a generally triangularly shaped third sidewall 78 that extends between the first and second sidewalls 74*a*, 74*b* and is substantially normal to the axis 30. The third sidewall 78 overlies at least a portion of the carburetor 54 and reduces the likelihood of unintentionally altering or otherwise disturbing the carburetor settings. It should be appreciated that the third sidewall 78 may also overlie any or all components of the fuel injection system or gaseous fuel mixer discussed above, in the event the engine 10 is equipped with such devices.

The third sidewall 78 defines a pair of mounting apertures 82 through which fasteners 86 can be extended to couple the removable housing portion 70 to the first housing portion 34. In some embodiments, the fasteners 86 include quarter-turn captive fasteners that are securely held in the apertures 82 in the third sidewall 78 when the removable housing portion 70 is removed from the first housing portion 34. Of course substantially any other fastener such as conventional threaded fasteners and the like can be used as well.

The removable housing portion 70 is also coupled to the first housing portion 34 by a male/female joint configuration. In the illustrated embodiment, the housing sidewalls 46 define a pair of slots 90*a*, 90*b*, adjacent each cylinder assembly 22*a*, 22*b*. The slots 90*a*, 90*b* extend generally from the front wall 42 toward the engine 10 and generally parallel to the axis 30. The removable housing portion 70 defines corresponding ribs 94*a*, 94*b* that are received by a respective slot 90*a*, 90*b* when the removable housing portion 70 is coupled to the first housing portion 34. Of course the first housing portion 34 could alternatively be provided with ribs, and the slots could be defined on the removable housing portion 70, if desired. Other non-sliding connections between the removable housing portion 70 and the first housing portion 34 can also be used.

To install the removable housing portion 70 for engine operation, each rib 94*a*, 94*b* is aligned with a respective slot

90*a*, 90*b* and the removable housing portion is urged toward the engine 10 in a direction that is substantially parallel to the axis 30. As the ribs 94*a*, 94*b* are received by the slots 90*a*, 90*b*, the first and second sidewalls 74*a*, 74*b* move into overlying relation with their respective access openings 50*a*, 50*b*. When the third sidewall 78 of the removable housing portion 70 is substantially aligned with the first wall 42 of the first housing portion 50, the fasteners 86 are extended through the mounting apertures 82 and into apertures 98 defined by the first housing portion 34, thereby securing the removable housing portion 70 thereto. To remove dirt and debris from the blower housing 14, or to perform other maintenance operations, the fasteners 86 are loosened and the removable housing portion 70 is slid away from the engine 10 until the ribs 94*a*, 94*b* clear the slots 90*a*, 90*b* and the access openings 50*a*, 50*b* are uncovered.

Figure 5:
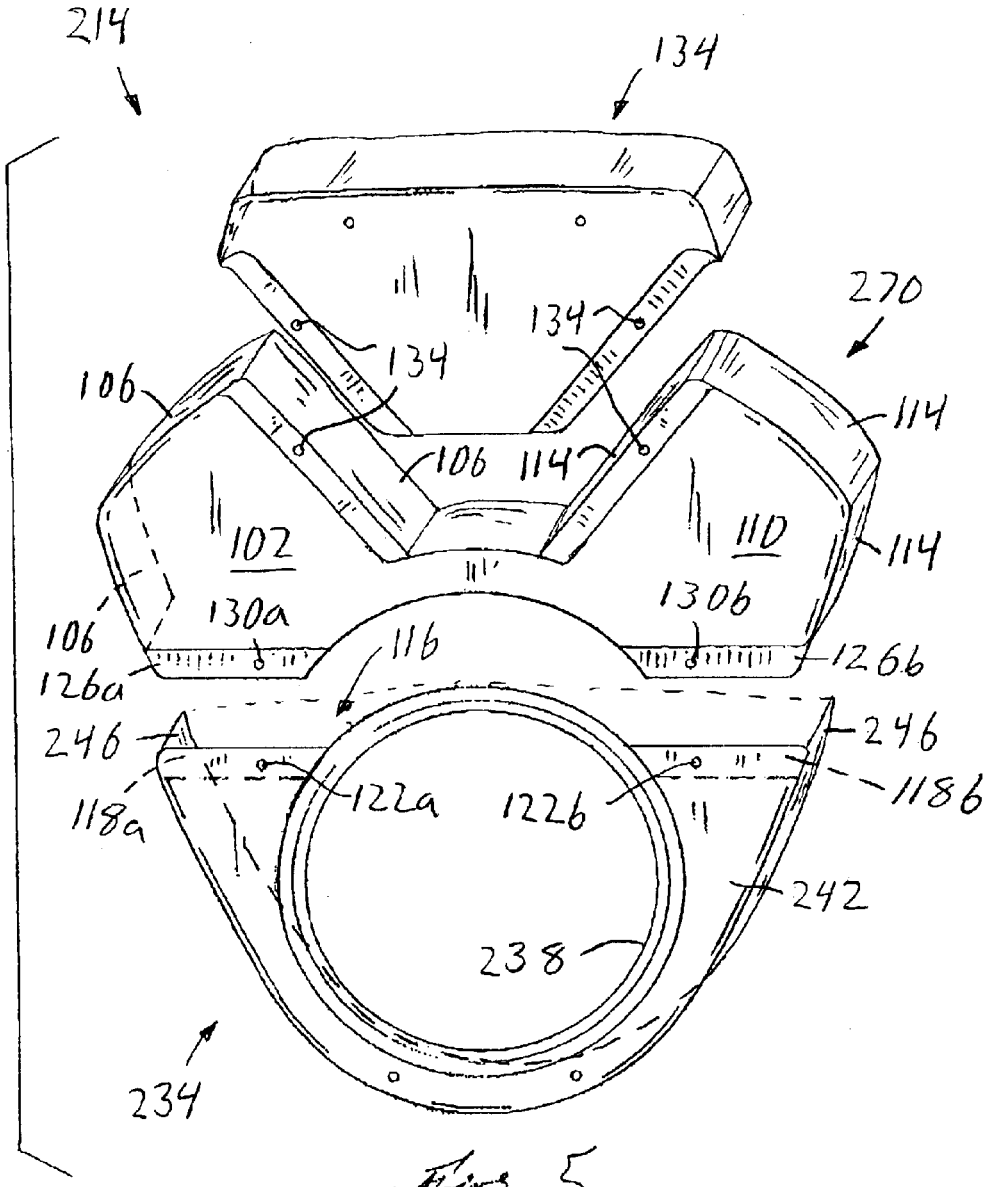
FIG. 5 is an exploded perspective view of an alternative blower housing embodying the invention.

FIG. 5 illustrates an alternative embodiment of the blower housing 214. Components of the blower housing 214 that are the same or similar to components of the blower housing 14 have been given the same reference numeral increased by two hundred. The first housing portion 234 includes a front wall 242 that defines an intake opening 238 and sidewalls 246 that are configured to overlie the engine block 18. The removable housing portion 270 of the blower housing 214 is configured to overlie the engine cylinder assemblies 22*a*, 22*b* and includes a first sidewall 78 that is spaced from the first cylinder assembly 22*a* and is substantially normal to the axis 30. Second sidewalls 106 extend from the first sidewall 102 toward the first cylinder assembly 22*a*. At least some portions of the second sidewalls 106 extend substantially parallel to the axis 30. The first and second sidewalls 102, 106 cooperate with one another and with the first housing portion 234 to direct air moved by the cooling fan 26 toward the first cylinder assembly 22*a*. Similarly configured third and fourth sidewalls 110, 114 cooperate with the first housing portion 234 to direct air moved by the cooling fan 26 toward the second cylinder assembly 22*b*. Of course if the engine 10 were a single cylinder or inline engine, the removable housing portion 270 could be reconfigured accordingly to have only the first and second sidewalls 54, 58.

The front wall 242 and the sidewalls 246 of the first housing portion 234 cooperate with the engine block 18 to define an access opening 116 that opens generally toward the engine cylinder assemblies 22*a*, 22*b*. The access opening 116 serves a similar purpose as the access openings 50*a*, 50*b* and affords access to the inside of the blower housing 214 for the removal of foreign material therefrom. The removable housing portion 270 can be coupled to the first housing portion 234 to close the access opening 116 and to overlie the cylinder assemblies 22*a*, 22*b* for directing cooling air toward the cylinder assemblies 22*a*, 22*b* during engine operation.

The front wall 242 of the first housing portion 234 defines a pair of recesses 118*a*, 118*b* that generally face the engine 10. The recesses 118*a*, 118*b* are positioned on opposite sides of the intake opening 238 adjacent the access opening 116. A pair of apertures 122*a*, 122*b* are also defined by the front wall 242 and each aperture 122*a*, 122*b* is positioned within a respective recess 118*a*, 118*b*. The removable housing portion 270 defines tabs 126*a*, 126*b* that are configured to be received by a respective recess 118*a*, 118*b* when the removable housing portion 270 is coupled to the first housing portion 234. The removable housing portion 270 also includes apertures 130*a*, 130*b* defined by respective tabs 126*a*, 126*b* that are alignable with the apertures 122*a*, 122*b* in the first housing portion 234. Fasteners (not shown) are extended through the aligned apertures to secure the removable housing portion 270 to the first housing portion 234. The removable housing portion 270 can therefore be simply removed to afford access to the inside of the blower housing 214 for cleaning and the like, without necessitating the removal of the entire blower housing 214.

The blower housing 214 also includes a removable carburetor cover 134 that is coupled to the removable housing portion 270 and in some aspects is similar to the removable housing portion 70. The carburetor cover 134 and the removable housing portion 270 include alignable holes 138 for coupling the carburetor cover 134 to the removable housing portion 270 with fasteners and the like. The carburetor cover 134 overlies the carburetor 54 for reasons similar to those discussed above with respect to the third sidewall 78 of the removable housing portion 70. However in the illustrated embodiment, because the second and fourth sidewalls 106, 114 are substantially continuous and extend around the periphery of the cylinder assemblies 22*a*, 22*b*, there are no openings (such as the openings 50*a*, 50*b*) that are covered by the carburetor cover 134. If desired however, the sidewalls 106, 114 of the removable housing portion 270 that face the carburetor 54 could be configured to define apertures similar to those defined by the sidewalls 46 of the first housing portion 34. The carburetor cover 134 would then be configured similarly to the removable housing portion 70 and would include sidewalls to overlie the apertures. Thus a blower housing having two removable portions would be provided, each removable portion affording access to the inside of the blower housing.

Various features of the invention are set forth in the following claims.

What is claimed is:

1. A blower housing for an engine that includes a cooling fan rotatable about an axis and at least one engine cylinder assembly having a cylinder and a cylinder head, the blower housing comprising:

a first housing portion, coupled to the engine, having an intake opening through which air may flow, and having a wall portion defining an access opening therein;

a removable housing portion coupled to the first housing portion and having first and second sidewalls that direct air toward the at least one engine cylinder assembly, the first sidewall covering the access opening; and a quick-release fastener coupling the removable housing portion and the first housing portion.

2. The blower housing of claim 1, wherein the first and second sidewalls are angled with respect to one another.

3. The blower housing of claim 1, wherein the removable housing portion includes a third sidewall that is substantially normal to the axis.

4. The blower housing of claim 1, wherein the removable housing portion is separable from the first housing portion to afford access to an outer surface of at least one of the engine cylinder assemblies.

5. The blower housing of claim 1, wherein the first housing portion defines a first aperture and the removable housing portion defines a second aperture, and wherein the first and second apertures are alignable to afford extension of a fastener through the first and second apertures to thereby couple the removable housing portion to the first housing portion.

6. The blower housing of claim 1, wherein the first housing portion receives a portion of the removable housing portion when the removable housing portion is coupled to the first housing portion.

7. The blower housing of claim 1, wherein the removable housing portion includes a third wall extending between the first and second sidewalls and generally normal to the axis.

8. The blower housing of claim 1, wherein the first and second sidewalls are substantially parallel to the axis.

9. The blower housing of claim 1, wherein the at least one engine cylinder assembly includes first and second engine cylinder assemblies, and wherein the first sidewall directs air toward the first cylinder assembly, and the second sidewall directs air toward the second cylinder assembly.

10. The blower housing of claim 1, wherein the engine includes an air/fuel mixing device, and wherein the removable housing portion overlies at least a portion of the air/fuel mixing device.

11. The blower housing of claim 1,wherein the removable housing portion is slideably engageable with the first housing portion.

12. The blower housing of claim 1, wherein the at least one engine cylinder assembly includes first and second engine cylinder assemblies angled with respect to one another, and wherein the first and second sidewalls direct air toward the first engine cylinder assembly.

13. The blower housing of claim 12, wherein the removable housing portion includes third and fourth sidewalls that direct air toward the second engine cylinder assembly.

14. The blower housing of claim 13, wherein the first and third sidewalls are substantially normal to the axis, and the second and fourth sidewalls are substantially parallel to the axis.

15. The blower housing of claim 1, wherein the intake opening is generally circular and is substantially concentric with the axis.

16. The blower housing of claim 1, wherein the fastener is a captive fastener.

17. The blower housing of claim 1, wherein the fastener is a quarter turn fastener.

18. A blower housing coupleable to an engine that includes a cooling fan rotatable about an axis and at least one engine cylinder assembly having a cylinder and a cylinder head, the blower housing comprising:

a first housing portion coupled to the engine and having an intake opening through which air may flow; and a removable housing portion, removably coupled to the first housing portion and having first and second sidewalls that direct air toward the at least one engine cylinder assembly, wherein the first housing portion defines a slot extending substantially parallel to the axis, and the removable housing portion defines a rib that is engageable with the slot when the removable housing portion is coupled to the first housing portion.

19. A blower housing coupleable to an engine that includes a cooling fan rotatable about an axis and at least one engine cylinder assembly having a cylinder and a cylinder head, the blower housing comprising:

a first housing portion coupled to the engine and having an intake opening through which air may flow; and a removable housing portion, removably coupled to the first housing portion and having first and second sidewalls that direct air toward the at least one engine cylinder assembly, wherein the first housing portion includes a recess, and the second housing portion includes a tab that is received by the recess.

20. The blower housing of claim 19, further comprising a quarter-turn fastener coupling the first housing portion and the removable housing portion.

21. A blower housing coupleable to an engine that includes a cooling fan rotatable about an axis and at least one engine cylinder assembly having a cylinder and a cylinder head, the blower housing comprising:

a first housing portion coupled to the engine and having an intake opening through which air may flow; and a removable housing portion, removably coupled to the first housing portion and having first and second sidewalls that direct air toward the at least one engine cylinder assembly, wherein the engine is a V-type engine and the first housing portion defines a first access opening that opens toward the first engine cylinder assembly, and a second access opening that opens toward the second engine cylinder assembly.

22. The blower housing of claim 21, wherein the first sidewall overlies the first access opening and the second sidewall overlies the second access opening when the removable housing portion is coupled to the first housing portion.

23. The blower housing of claim 21, further comprising a quarter-turn fastener coupling the first housing portion and the removable housing portion.

24. The blower housing of claim 23, wherein the fastener is a captive fastener.

25. A blower housing coupleable to an engine that includes a cooling fan rotatable about an axis and at least one engine cylinder assembly having a cylinder and a cylinder head, the blower housing comprising:

a first housing portion coupled to the engine and having an intake opening through which air may flow; and a removable housing portion, removably coupled to the first housing portion and having first and second sidewalls that direct air toward the at least one engine cylinder assembly, wherein the engine includes an intake manifold having a first runner extending toward the first engine cylinder assembly, and a second runner extending toward the second engine cylinder assembly, each runner including an outwardly extending flange portion, and wherein each flange portion cooperates with the first housing portion to define respective ones of the first and second access openings.

26. A blower housing coupleable to an engine that includes a cooling fan rotatable about an axis and at least one engine cylinder assembly having a cylinder and a cylinder head, the blower housing comprising:

a first housing portion coupled to the engine and having an intake opening through which air may flow; and a removable housing portion, removably coupled to the first housing portion and having first and second sidewalls that direct air toward the at least one engine cylinder assembly, wherein the engine includes at least two engine cylinder assemblies and an air/fuel mixing device positioned between the engine cylinder assemblies, the blower housing further comprising a cover removably coupled to the removable housing portion and overlying at least a portion of the air/fuel mixture device.

27. The blower housing of claim 26, further comprising a quarter-turn fastener coupling the first housing portion and the removable housing portion.

28. A blower housing coupleable to an engine that includes a cooling fan rotatable about an axis and at least one engine cylinder assembly having a cylinder and a cylinder head, the blower housing comprising:

a first housing portion coupled to the engine and having an intake opening through which air may flow; and a removable housing portion, removably coupled to the first housing portion and having first and second sidewalls that direct air toward the at least one engine cylinder assembly, wherein the engine includes at least two engine cylinder assemblies, and wherein the first housing portion defines an access opening that opens toward the first and second cylinder assemblies, and wherein the removable housing portion overlies the access opening and at least portions of each engine cylinder assembly when the removable housing portion is coupled to the first housing portion.

29. A blower housing for an engine that includes a cooling fan rotatable about an axis and at least one engine cylinder assembly having a cylinder and a cylinder head, the blower housing comprising:

a first housing portion coupled to the engine and having an intake opening through which air may flow;

an integrally-formed one-piece housing, removably coupled to the first housing portion and having a first sidewall and a second sidewall angled relative to the first sidewall, the first sidewall at least partially covering the intake opening; and a quick-release fastener coupling the one-piece housing and the first housing portion.

30. The blower housing of claim 29, wherein the fastener is a quarter-turn fastener.

31. The blower housing of claim 29, wherein the fastener is a captive fastener.

32. A blower housing for an engine that includes a cooling fan rotatable about an axis and at least one engine cylinder assembly having a cylinder and a cylinder head, the blower housing comprising:

a first housing coupled to the engine and having an intake opening through which air may flow; and a removable housing including a first sidewall and a second sidewall that direct air toward the at least one engine cylinder assembly, the removable housing portion being movable a distance along an axis between an engaged position and a disengaged position, a portion of the removable housing being interlocked with a portion of the first housing for a substantial portion of the distance between the engaged position and the disengaged position.

33. The blower housing of claim 32, wherein the fastener is a quarter-turn fastener.

34. The blower housing of claim 32, wherein the fastener is a captive fastener.

* * * * *